United States Patent [19]

Gendron

[11] 4,129,214

[45] Dec. 12, 1978

[54] TWO COMPARTMENTED ENVELOPE

[75] Inventor: Wilfred H. Gendron, Wilbraham, Mass.

[73] Assignee: Westvaco Corporation, New York, N.Y.

[21] Appl. No.: 882,072

[22] Filed: Mar. 1, 1978

[51] Int. Cl.[2] ..... B65D 27/34; B65D 27/08

[52] U.S. Cl. ..... 206/629; 206/610; 229/72

[58] Field of Search ..... 229/71, 72, 73; 206/610, 611, 629

[56] References Cited

U.S. PATENT DOCUMENTS

| | | | |
|---|---|---|---|
| 192,522 | 6/1877 | Marshall | 229/73 |
| 2,055,716 | 9/1936 | Berkowitz | 229/71 |
| 2,867,372 | 1/1959 | Fox | 206/610 |
| 3,140,817 | 7/1964 | Fitzgerald | 229/72 |
| 3,158,313 | 11/1964 | Hubbard | 229/71 |
| 3,420,432 | 1/1969 | Cooper | 229/72 |

FOREIGN PATENT DOCUMENTS

| | | | |
|---|---|---|---|
| 186490 | 10/1922 | United Kingdom | 229/71 |

*Primary Examiner*—Stephen P. Garbe

[57] ABSTRACT

A compartmented mailing envelope for combining both first and third class mail includes a small front compartment and a larger rear compartment. The two compartments are formed from a blank of paper on which there is adhered a patch of paper. A single top closure flap is foldably attached to one end of the blank for sealing both compartments simultaneously. Meanwhile, a means is provided in conjunction with the top closure flap to provide access to the small front compartment without disturbing the contents of the larger rear compartment.

3 Claims, 6 Drawing Figures

FIG 3.
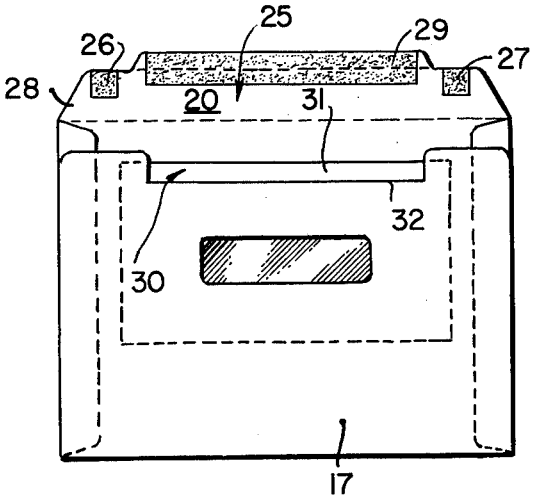
FIG 4.
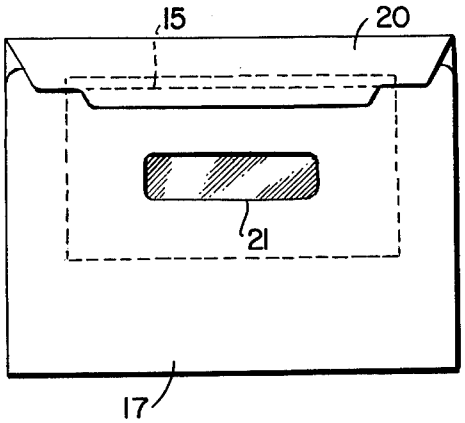
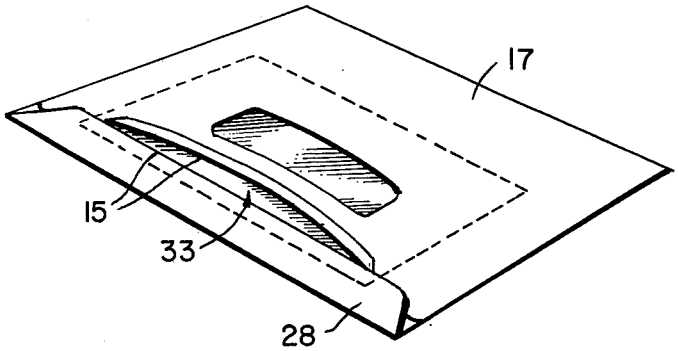
FIG 5.
FIG 6.
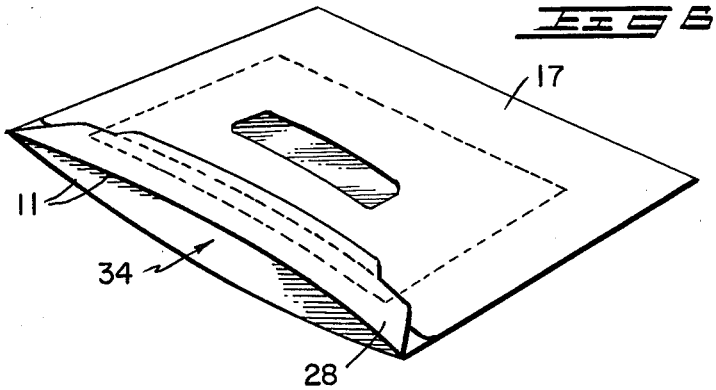

TWO COMPARTMENTED ENVELOPE

BACKGROUND OF INVENTION

The present invention relates to a two compartment envelope construction for combining both first and third class mail wherein the first class compartment can be opened independently of the third class compartment and vice versa.

Present postal regulations permit the affixing of a first class letter to a package or envelope containing material mailed by another postal class. This technique is used for such purposes as sending letters and stock proxy forms (by first class mail) in conjunction with annual reports or other printed matter (by third class mail), or for sending printed matter or small items of merchandise in conjunction with a letter, bill or draft.

Such an envelope is disclosed in U.S. Pat. No. 3,420,432, wherein an independent means is incorporated into the front panel of an envelope for permitting access to the first class compartment. For this purpose, a pair of diverging perforated lines 38,40 are applied to the envelope front panel 20 in the vicinity of the window 34 of the envelope. Accordingly, for gaining access to the first class compartment, one severs the perforations at lines 38,40 to tear away a portion of the front panel.

The disadvantage of the above noted prior art construction is that the means for permitting independent access to the first class compartment substantially destroys the front panel of the envelope and otherwise provides an unreliable opening means.

In contrast to the above, applicant herein incorporates within the normal envelope closing flap a means which permits a reliable, neat and convenient access to the first class compartment.

SUMMARY OF INVENTION

The present invention relates to compartmented envelopes and more particularly to a two compartmented envelope which is closed by a single closure flap. Envelopes of the kind disclosed herein have particular utility for the combined mailing of both first and third class matter.

The envelope is prepared from a first blank of material such as paper, to which there is adhered a second blank of paper in the form of a patch for forming the compartments of the envelope. The first blank of paper comprises essentially a rectangular front panel and back panel, a pair of abbreviated side flaps and a top closure flap. The second blank comprises a rectangular patch that is adhered to either the front or back panel of the first blank to form a first compartment between the patch and the adhered front or back panel and a second compartment between essentially the patch and the remaining unadhered panel.

In the preferred embodiment, the rectangularly shaped back panel has a pair of abbreviated side closure flaps foldably attached to an opposed pair of side edges, a top closure flap foldably attached to a top edge and a rectangularly shaped front panel foldably attached to a bottom edge. The front panel includes a window aperture, and is applied with spaced lines of adhesive for the purpose of adhering thereto a rectangular patch which forms a first windowed front compartment for the envelope. Subsequently, with adhesive applied either to the side closure flaps or to the front panel along the side edges, the front and back panels are adhered together to form a second compartment generally larger than the first compartment. Meanwhile, the top closure flap is contoured for simultaneous sealing of both compartments and further includes a perforated score for permitting access to the first windowed compartment without disturbing the contents of the second compartment.

DESCRIPTION OF DRAWING

FIG. 3 illustrates the completed envelope construction prior to sealing;

FIG. 4 shows a sealed envelope;

FIG. 5 shows the envelope of FIG. 4 with the first compartment open; and FIG. 6 shows the envelope with the second compartment open.

DETAILED DESCRIPTION

The drawings illustrate the envelope of the present invention as well as the progressive steps for adhering the second envelope blank to the first blank and then folding and gluing the panels into a finished product.

Figure 1:
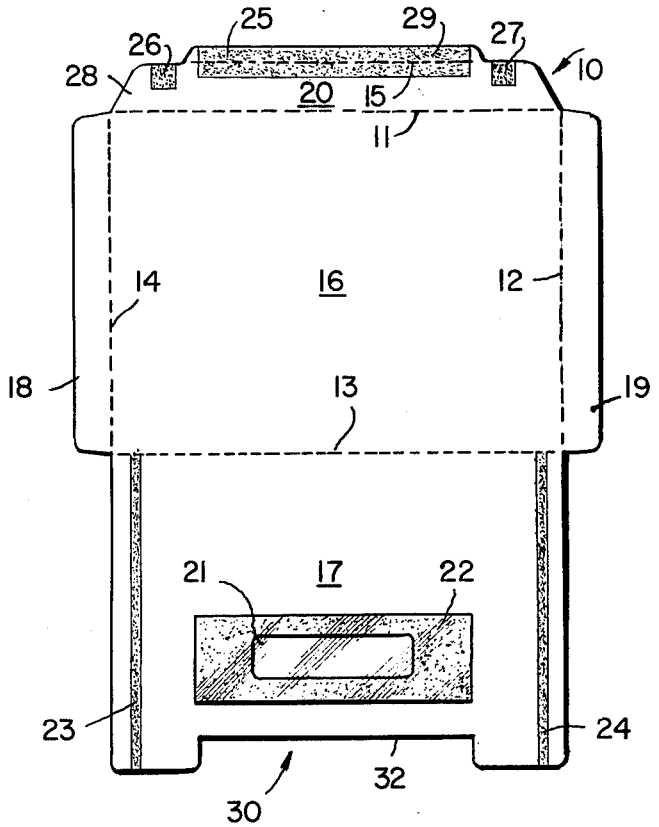
FIG. 1 is a plan view of the first blank prior to being folded into its finished envelope construction.
Figure 2:
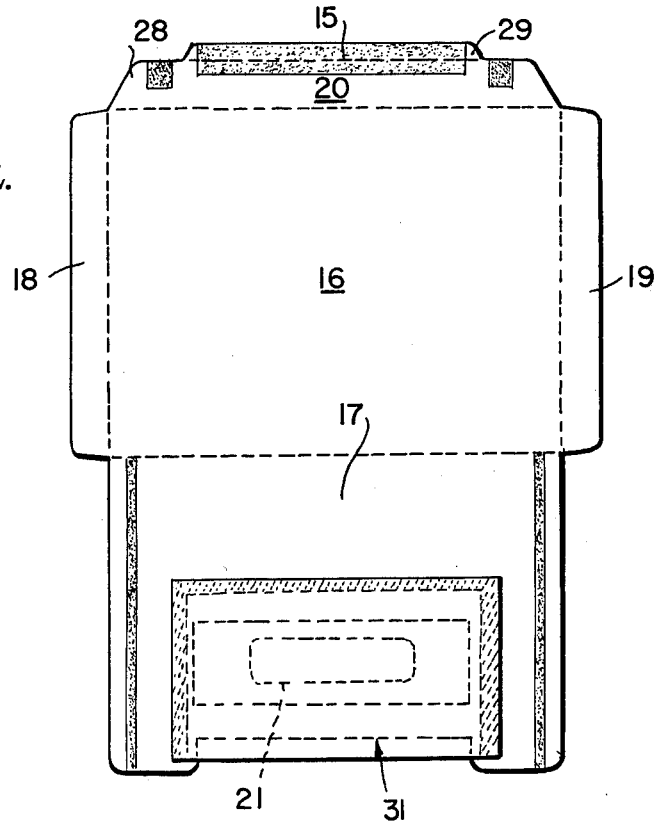
FIG. 2 shows the first blank with a second blank patch adhered thereto.

The first blank 10 comprises a substantially elongated sheet scored with fold lines 11, 12, 13 and 14 to define an envelope rear panel 16, a front panel 17, a pair of side flaps 18, 19 and a contoured end closure flap 20. FIG. 1 shows the blank 10 with its inside surface up to illustrate the adhesive pattern applied thereto and the location of the window aperture 21 in front panel 17. Window aperture 21 is illustrated as being covered by a substantially transparent material 22 such as cellophane or the like. The window material 22 is adhered to the inside of front panel 17 substantially as shown in FIG. 1. Meanwhile, front panel 17 is recessed at 30 to coincide with the contoured nature of the closure flap 20 and to provide an insertion throat for the first envelope compartment when the second envelope blank 31 is adhered to the inside of front panel 17. FIG. 2 shows the blank 10 of FIG. 1 with blank 31 adhered at three sides around window 21. Blank 31 is positioned on panel 17 so as to cover a portion of the recessed area 30 and provide the aforementioned throat which aids in the mechanical insertion of first class matter into the envelope front compartment formed between blank 31 and the inside of panel 17. Window 21 permits the insertion of preaddressed items into the front compartment.

After blank 31 is adhered to blank 10 to form the first envelope compartment, the remainder of the envelope is formed when side flaps 18,19 are folded over about scored lines 14,12 respectively, and the front panel 17 is folded over about score line 13 to adhere panel 17 to the flaps 18,19. FIG. 3 illustrates the envelope in a finished condition and ready for insertion of its contents. It will be seen from studying FIG. 3 that the front compartment between panel 17 and patch blank 31 is readily accessible because of the recess at 30 of panel 17. In addition, since the front panel 17 is not full height, i.e., is not as high as the rear panel 16, the rear compartment formed by rear panel 16 and patch blank 31 is also readily accessible. Thus, both compartments can be machine inserted and no special addressing or matching is required.

FIGS. 1, 2 and 3 each show the details of the contoured top closure flap 20 along with the preferred adhesive pattern for preparing the finished envelope and for sealing the envelope closed. For this purpose, a pair of adhesive strips 23,24 are applied, in the alternative, either to the inside of front panel 17 or to the back side of flaps 18,19 for adhering the front panel to the side flaps 18,19. Meanwhile, with the contoured top closure flap divided into two portions 28,29 by a perforated line 15, another strip of adhesive 25 is applied to the flap 20 which overlaps the perforated line 15. Finally, a pair of adhesive spots 26,27 are also applied to the outboard edges of the portion 28 of top closure flap 20.

Adhesive strip 25 accomplishes two purposes. When the top closure flap 20 is folded about score line 11 to simultaneously seal both compartments, the perforated line 15 is arranged to be substantially coincident with the edge 32 of recessed portion 30 of front panel 17. Thus, the adhesive 25 on portion 29 of flap 20 becomes adhered to the front panel 17 to seal the front compartment 33. Meanwhile, the overlapped part of adhesive strip 25 on portion 28 of flap 20 becomes adhered to the exposed portion of blank 31 in the vicinity of recess 30. This arrangement accomplishes the purpose of sealing the central portion of the second envelope compartment 34. At the same time, the adhesive patches 26,27 seal the outer edges of the second envelope compartment 34. Thus the contoured closure flap 20 permits simultaneous sealing of both the first and second envelope compartments with less adhesive than competitive products. Moreover, with the perforated line 15 substantially coincident with edge 32 of panel 17, the closure flap 20 can be separated along line 15 to permit access to the matter in the front or first class compartment independent of the third class matter in the second compartment. FIG. 5 illustrates the envelope opened along perforated line 15 to permit access to compartment 33. Meanwhile, the second compartment 34 is accessible simply by severing the envelope along any one of the fold lines 11, 12, 13 or 14. FIG. 6 shows the envelope severed along score line 11 to permit access to compartment 34.

From the foregoing it will be seen that a novel envelope construction has been provided for combining both first and third class mailing matter wherein independent access is permitted for each class without disturbing the other. The patch blank 31 is preferably slightly smaller than front panel 17 so as not to interfere with the side seams formed by flaps 18 and 19. On the other hand, the depth of the front compartment is only limited by the fact that a portion of the blank 31 must extend into the recess area 30 for proper gluing and to provide the aforementioned throat for aiding in the insertion of first class matter. The contoured nature of the top closure flap 20 is not to be limited by the preferred embodiment disclosed. The only requirement is that the contour of flap 20 and the recess 30 must match one another. Thus, various changes in the dimensions, arrangements and other details of the present invention may be made to the fully described embodiment without departing from the principles of the invention as defined in the appended claims.

I claim:

1. A two compartment envelope comprising, in combination, a first generally rectangular blank defined by a rear panel and a front panel foldably attached to one another along a transverse fold line, a pair of side closure flaps foldably attached to the side edges of said rear panel and a top closure flap foldably attached to the upper transverse edge of said rear panel, and a second blank in the form of a patch adhered to the inside surface of said front panel, the improvement comprising:

(a) a recess along the transverse edge of said front panel remote from the fold line connecting said front and rear panels;

(b) a contoured extension along the transverse edge of said top closure flap for simultaneously sealing the first envelope compartment formed between said front panel and said patch and the second compartment formed between said rear panel and said patch;

(c) a perforated line in said top closure flap located so as to separate the contoured extension of said top closure flap from the main portion thereof for permitting independent access to said first compartment without disturbing the contents of said second compartment; and, (d) a pattern of adhesive applied to said top closure flap in the form of a centrally located strip that overlaps said perforated line and a pair of separate patches outboard of said centrally located strip whereby said centrally located adhesive strip simultaneously seals the first compartment and the central portion of said second compartment while said adhesive patches seal the outboard portions of said second compartment.

2. The envelope of claim 1 wherein said patch blank is smaller in size than said front panel and slightly overlaps the recess along the transverse edge of said front panel to form a throat area for insertion of mailing matter into said front compartment.

3. A two compartment envelope for both first and third class mail comprising a rear panel having transverse upper and lower edges and a pair of end edges, a pair of side flaps foldably attached to said end edges, a top closure flap foldably attached to the upper transverse edge, a front panel foldably attached to said lower transverse edge and a generally rectangular patch having dimensions slightly smaller than said front panel adhered along three sides to the inside of said front panel to form the first class compartment, the improvement comprising:

(a) a contoured extension along the outer edge of said top closure flap;

(b) a cooperating recess along the free edge of said front panel to coincide with the contoured extension on said closure flap;

(c) a perforated line separating the contoured extension of said top closure flap from the main portion thereof for permitting access to said first class compartment independently of the main body of said envelope; and, (d) a centrally located adhesive strip that overlaps said perforated line applied to said top closure flap for simultaneously sealing both compartments of said envelope and a pair of separate adhesive patches located outboard of said centrally located adhesive strip for sealing the outboard portions of the main body of said envelope.

* * * * *